US011739723B1

(12) United States Patent
Leedy et al.

(10) Patent No.: US 11,739,723 B1
(45) Date of Patent: Aug. 29, 2023

(54) IGNITION INTERRUPTER AND RELATED METHODS

(71) Applicant: Zombiebox International, Inc., Gilbert, AZ (US)

(72) Inventors: Timothy David Leedy, Gilbert, AZ (US); Kim R. Rogers, Glendale, AZ (US)

(73) Assignee: ZombieBox International, Inc., Gilbert, AZ (US)

( * ) Notice: Subject to any disclaimer, the term of this patent is extended or adjusted under 35 U.S.C. 154(b) by 0 days.

(21) Appl. No.: 17/646,283

(22) Filed: Dec. 28, 2021

Related U.S. Application Data

(63) Continuation-in-part of application No. 17/141,611, filed on Jan. 5, 2021, now Pat. No. 11,208,978, which is a continuation of application No. 16/359,679, filed on Mar. 20, 2019, now Pat. No. 10,883,469.

(60) Provisional application No. 62/645,325, filed on Mar. 20, 2018.

(51) Int. Cl.

| | |
|---|---|
| ***F02P 11/00*** | (2006.01) |
| ***F02P 7/077*** | (2006.01) |
| ***H01H 37/54*** | (2006.01) |

(52) U.S. Cl.
CPC ..... *F02P 7/077* (2013.01); *F02P 11/00* (2013.01); *H01H 37/54* (2013.01); *H01H 37/5409* (2013.01)

(58) Field of Classification Search
CPC ..... H01H 37/54; H01H 37/5409; F02P 7/077; F02P 11/00
See application file for complete search history.

(56) References Cited

U.S. PATENT DOCUMENTS

| | | | | |
|---|---|---|---|---|
| 1,712,221 | A | 5/1929 | Larsson | |
| 2,917,662 | A | 12/1959 | Cunningham | |
| 3,100,246 | A | 8/1963 | Riley | |
| 4,010,379 | A | 3/1977 | Shimamoto | |
| 4,204,511 | A | 5/1980 | Morris | |
| 4,407,255 | A | 10/1983 | Bulter | |
| 4,426,975 | A | 1/1984 | Susuki et al. | |
| 4,490,799 | A | 12/1984 | Marino et al. | |
| 4,502,324 | A | 3/1985 | Marino et al. | |
| 4,757,788 | A * | 7/1988 | Simons | F02P 3/04 123/179.5 |
| 5,049,786 | A * | 9/1991 | Gotisar | H01T 1/00 315/209 T |
| 2004/0255888 | A1* | 12/2004 | Tuohy | F02P 9/007 361/255 |
| 2007/0217106 | A1 | 9/2007 | Lagnoux | |
| 2009/0284022 | A1* | 11/2009 | Usselman | F02N 11/0862 320/137 |
| 2009/0318000 | A1* | 12/2009 | Connell | H01H 1/54 439/251 |

(Continued)

*Primary Examiner* — Jacob R Crum
(74) *Attorney, Agent, or Firm* — IPTechLaw

(57) ABSTRACT

Implementations of a system for interrupting ignition may include a first spark plug terminal coupled with a first internal contact, the first internal contact extending into a housing; a second spark plug terminal coupled with a second internal contact, the second internal contact extending into the housing; a contactor biased against the first internal contact and the second internal contact; a plunger coupled with a solenoid coupled within the housing; a battery coupled with the solenoid; and a temperature sensor coupled with the battery and the solenoid.

20 Claims, 12 Drawing Sheets

(56) References Cited

U.S. PATENT DOCUMENTS

| | | | | |
|---|---|---|---|---|
| 2013/0021119 | A1* | 1/2013 | Sid | G08B 17/117 335/1 |
| 2014/0292472 | A1 | 10/2014 | Qin et al. | |
| 2015/0084721 | A1* | 3/2015 | Ziegler | H01H 50/18 335/18 |
| 2015/0357138 | A1 | 12/2015 | Kamiyama et al. | |
| 2017/0110279 | A1 | 4/2017 | Yang et al. | |
| 2018/0175539 | A1 | 6/2018 | Bhosale et al. | |

* cited by examiner

IGNITION INTERRUPTER AND RELATED METHODS

CROSS REFERENCE TO RELATED APPLICATIONS

This document claims the benefit of the filing date of U.S. Provisional Patent Application 62/645,325, entitled "Ignition Interrupter and Related Methods" to Leedy, et al. which was filed on Mar. 20, 2018, the disclosure of which is hereby incorporated entirely herein by reference.

This application is a continuation-in-part of U.S. patent application Ser. No. 17/141,611 to Leedy, et al., entitled "Ignition Interrupter and Related Methods," filed Jan. 5, 2021, now pending; which is a continuation of U.S. patent application Ser. No. 16/359,679 to Leedy, et al., entitled "Ignition Interrupter and Related Methods," filed Mar. 20, 2019, now U.S. Pat. No. 10,883,469, issued Jan. 5, 2020, the disclosures of each of which are hereby incorporated entirely herein by reference.

BACKGROUND

1. Technical Field

Aspects of this document relate generally to devices and methods for controlling the operation of motors, such as the ignition, or interruption of the ignition, of internal combustion motors, spark plugs, and electrical circuits not otherwise used in internal combustion motors.

2. Background

A spark plug operates by receiving voltage at a terminal of the spark plug. Spark plugs may be used in combustion engines to ignite compressed fuel and power a motor. Spark plugs draw power from a battery or other power source.

SUMMARY

Implementations of a system for interrupting ignition may include a first spark plug terminal coupled with a first internal contact, the first internal contact extending into a housing; a second spark plug terminal coupled with a second internal contact, the second internal contact extending into the housing; a contactor biased against the first internal contact and the second internal contact; a plunger coupled with a solenoid coupled within the housing; a battery coupled with the solenoid; and a temperature sensor coupled with the battery and the solenoid.

Implementations of ignition interrupters may include one, all, or any of the following:

The solenoid may be configured to move the plunger against the contactor to break an electrical connection with the first internal contact and with the second internal contact when the temperature sensor indicates a predetermined temperature threshold may have been passed.

The interrupter may include a comparator coupled with an output of the temperature sensor, the comparator configured to send a signal to the solenoid when the predetermined temperature threshold may have been passed.

The interrupter may include a resistor coupled with a power regulator coupled with the battery, the resistor configured to set a reference voltage for the comparator corresponding with the predetermined temperature threshold.

The interrupter may include a magnet coupled to the housing.

The first spark plug terminal and the second spark plug terminal may be configured to couple with spark plug wires coupled with a spark plug.

The contactor may be a plate.

Implementations of a system for interrupting ignition may include a first spark plug terminal coupled with a second spark plug terminal through a contactor plate in contact with a first internal contact and a second internal contact, the first spark plug terminal and second spark plug terminal extending from a housing. The system may include a plunger coupled with a solenoid coupled within the housing; and a temperature sensor coupled with the solenoid.

Implementations of a system of interrupting ignition may include one, all, or any of the following:

The solenoid may be configured to move the plunger against the contactor plate to break an electrical connection with the first internal contact and with the second internal contact when the temperature sensor indicates a predetermined temperature threshold may have been passed.

The system may include a comparator coupled with an output of the temperature sensor, the comparator configured to send a signal to the solenoid when the predetermined temperature threshold may have been passed.

The system may include a resistor coupled with a power regulator coupled with a battery, the resistor configured to set a reference voltage for the comparator corresponding with the predetermined temperature threshold.

The system may include a magnet coupled to the housing.

The first spark plug terminal and the second spark plug terminal may be configured to couple with spark plug wires coupled with a spark plug.

The contactor plate may be spring biased.

Implementations of a method for interrupting ignition may include coupling a first spark plug terminal with a first spark plug wire; coupling a second spark plug terminal with a second spark plug wire; and, using a temperature sensor, generating a voltage signal corresponding with an ambient temperature of a housing to which the first spark plug terminal and the second spark plug terminal may be coupled. The method may include, using a comparator, sending a signal to activate a solenoid when the voltage signal received from the temperature sensor exceeds a reference voltage corresponding with a predetermined temperature threshold; breaking a contact between a contactor plate at the first spark plug terminal and second spark plug terminal using a plunger coupled with the solenoid; and stopping flow of electricity to a spark plug coupled with the first spark plug wire and the second spark plug wire through breaking the contact of the contactor plate.

Implementations of a method for interrupting ignition may include one, all, or any of the following:

A resistor coupled with a power regulator may be included and the method may include setting the reference voltage for the comparator corresponding with the predetermined temperature threshold using the resistor.

A magnet may be coupled to the housing.

The contactor plate may contact a first internal contact of the first spark plug terminal and a second internal contact of the second spark plug terminal.

The method may include biasing the contactor plate against the first internal contact and against the second internal contact.

The method may include resuming flow of electricity to a spark plug coupled with the first spark plug wire and the second spark plug wire through restoring contact of the contactor plate when the comparator stops sending the signal to activate the solenoid.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended ignition interrupters will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such ignition interrupters, and implementing components and methods, consistent with the intended operation and methods.

A spark plug operates by receiving voltage at a terminal of the spark plug. The spark plug typically includes a gap between a center electrode and a ground electrode. Initially, no current can flow between the center electrode and the ground electrode as the gases between the two act as an insulator. However, as voltage builds up within the center electrode, the structure of the gases between the center electrode and the ground electrode begin to change. As the voltage exceeds the dielectric strength of the gases, the gases become ionized and allow current to flow across the gap producing the spark. Spark plugs have been used in combustion engines to ignite compressed fuel and power a motor.

Spark plug interrupters have included devices and methods of interrupting the ignition within the actual spark plug. Various examples include devices having conductive fuses within the actual spark plug device which melt to break the conductive path within the spark plug, or actual detonations within the spark plug which interrupt the conductive path within the spark plug.

Disclosed herein is a system and methods for an ignition interrupter which is universal, in-line with a spark plug and not actually part of the spark plug, user resettable and/or reusable, and thermally activated. Particular implementations of the ignition interrupters disclosed herein may be used with spark plugs used in, by non-limiting example, generators, cars, machinery, or any other system including an internal combustion engine, or electrical circuits not otherwise used in internal combustion motors.

Figure 1:
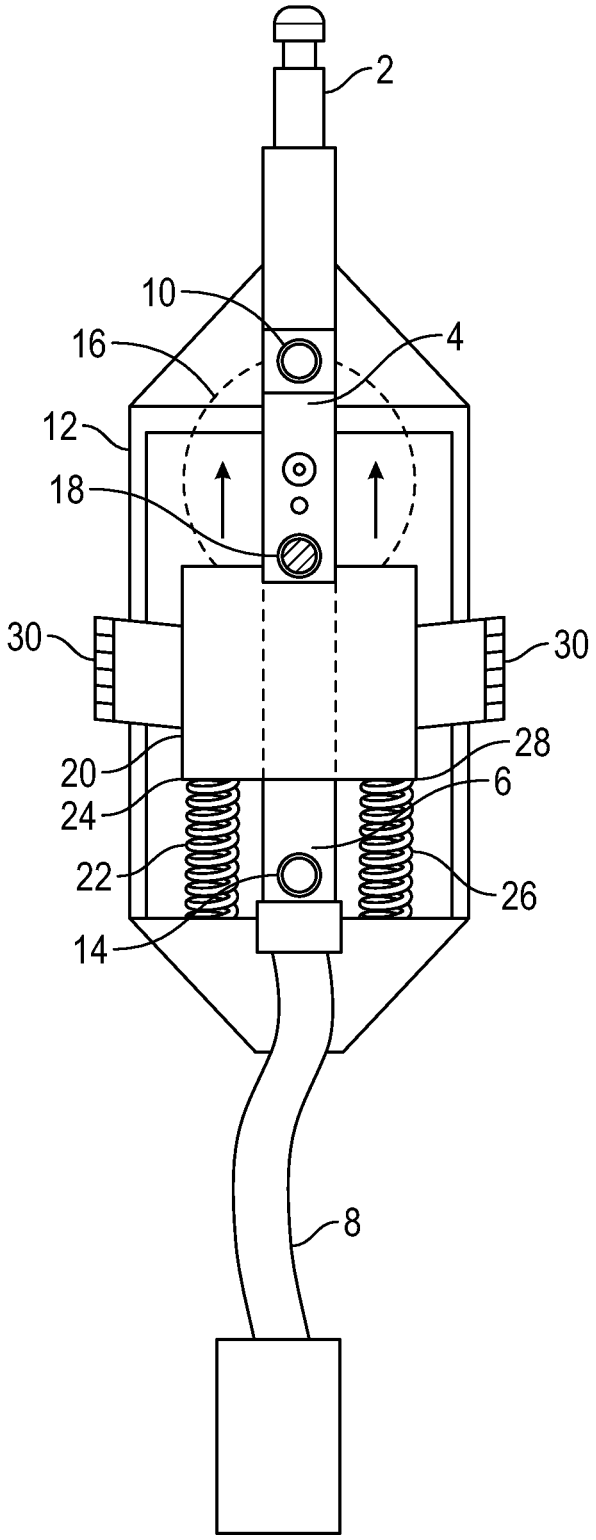
FIG. 1 illustrates a top view of an implementation of an ignition interrupter.

Referring to FIG. 1, a top view of an implementation of an ignition interrupter is illustrated. As illustrated, the ignition interrupter may include a spark plug terminal 2 configured to couple to a spark plug, or other ignition device. The spark plug terminal 2 may be made of any conductive material, and in particular implementations, may be the same as or similar to the terminals used on spark plugs. In various implementations, the shape of the spark plug terminal 2 may match the shape of the terminal of the spark plug which the ignition interrupter is configured to interrupt. As illustrated, a first conductive tab 4 may be coupled to the spark plug terminal 2. In various implementations, by non-limiting example, the first conductive tab 4 may run parallel with, and overlap with, a second conductive tab 6. In other implementations, the first conductive tab 4 and the second conductive tab 6 may be positioned perpendicularly, or in any other position where they overlap, or connect at any point in order to complete an electrical connection. As illustrated, the second conductive tab 6 may be configured to couple with a spark plug wire 8. Similar to the spark plug terminal 2, a terminal end of the spark plug wire 8 may be shaped and configured to receive a terminal of the spark plug which the spark plug interrupter is configured to interrupt. The first conductive tab and the second conductive tabs may be formed of copper, nickel, and other conductive materials.

In various implementations, the spark plug terminal 2 of the ignition interrupter may be configured to be compatible with many different types of motor systems. Similarly, the terminal end of the spark plug wire 8 may be configured to receive many different types of terminal designs used for various spark plugs. In this manner, the ignition interrupter may be designed to be used universally as a signal interrupter, and may be compatible with various systems and types of spark plugs. In particular implementations, the spark plug terminal 2 of the ignition interrupter may be configured to be compatible with motor systems of generators and the terminal end of the spark plug wire 8 may be configured to receive terminals of spark plugs used with generator systems. The ignition interrupter is configured to be used in-line with spark plugs. Conventional spark plug interrupters have always interrupted the spark within the actual spark plug, or at a spark controller or distributor. In contrast, the ignition interrupter disclosed herein may be added to existing systems between the terminal of the spark plug and the electrode of the system configured to contact the terminal of the spark plug. An in-line system, such as those disclosed herein, may eliminate the need to manufacture new spark plugs, or install complicated controls or additional sensors and electronics, as the interrupter can be added to any existing system and may interrupt any existing spark plug based on, among other factors, ambient air temperature near the spark plug.

Still referring to FIG. 1, the first conductive tab 4 may be coupled to a base 12 by a first tab holder 10, and the second conductive tab 6 may be coupled to the base 12 by a second tab holder 14. In various implementations, by non-limiting example, the first conductive tab 4 and the second conductive tab 6 may be held in place by any other method of attachment or coupling, including coupling directly with the base 12.

Still referring to FIG. 1, a snap disc 16 may be included in the ignition interrupter and may be coupled to a side of the base 12 opposite the first tab holder 10 and the second tab holder 14. In various implementations, the snap disc 16 may be circular in shape, rectangular, or any other shape. As illustrated, a pin 18 may be coupled with the snap disc 16. In various implementations, by non-limiting example, the pin may extend through the base 12 and couple with a second end 44 of the second conductive tab 6, and extend through an opening in the first conductive tab 4. As illustrated, the ignition interrupter may include a sled 20. In various implementations, the sled 20, or breaker, is a non-conductive material which includes a conductive portion therein. In various implementations, by non-limiting example, the sled 20 may include a first end 24 and a second end 28. As illustrated, the sled 20 may be positioned substantially perpendicular to a plane of the first conductive tab 4 and the second conductive tab 6. As illustrated, the sled 20 may be coupled between the first conductive tab 4 and the second conductive tab 6. In various implementations, the sled 20 may be configured to move along a plane parallel with the first conductive tab 4 and the second conductive tab 6 to an open position in a gap between the first conductive tab 4 and the second conductive tab 6, decompressing a first spring 22 and a second spring 26. In various implementations, the movement of the sled 20 to the open position may break an electrical connection between the first conductive tab 4 and the second conductive tab 6, by creating a gap between the first conductive tab 4 and the second conductive tab 6, thereby preventing the flow of voltage through the spark plug terminal 2 and the spark plug wire 8. In various implementations, the first conductive tab 4 and the second conductive tab 6, when touching, may allow the flow of voltage between the first conductive tab 4 and the second conductive tab 6, when the sled 20 is in a closed position, and there is no gap between them. By bridging the gap within the conductive tabs, a complete conductive path may be formed between the spark plug terminal 2 and the spark plug wire 8, and in turn, voltage applied from a battery (or other power source) may be received by a spark plug. In various implementations, when the sled 20 is moved to the closed position, the first spring 22 and the second spring 26 may be compressed.

In other implementations, the sled 20 may move in any other direction to break the circuit between the spark plug terminal 2 and the spark plug wire 8. Such a movement may include, by non-limiting example, sliding perpendicular to the first conductive tab 4 and the second conductive tab 6, rather than parallel to the conductive tabs, or rotating a conductive portion of the sled 20 into an open/broken position. In particular implementations, only a conductive portion of the sled 20 may move to open/break the conductive path. In still other implementations, rather than breaking the conductive path by physically moving a conductive portion of the sled 20, the conductive path may be broken through changing the conductive properties of the conductive portion, or by interrupting the conductive path using any other method or technique.

Still referring to FIG. 1, as illustrated, the ignition interrupter may include at least one reset tab 30. In various implementations, by non-limiting example, the reset tab 30 may be coupled to the sled 20, on one end of the sled 20, on either end of the sled 20, or on any other location on or along the sled 20. In various implementations, the reset tab 30 may be configured to move the sled 20 to the closed position out of the gap between the first conductive tab 4 and the second conductive tab 6, where the movement compresses the first spring 22 and the second spring 26. In various implementation, the reset tab 30 may be used to reset the ignition interrupter, or to move the sled 20 back into the closed position after the system has been triggered to break the electrical connection, thereby restoring the flow, or the ability of the electricity to flow, between the spark plug terminal and the spark plug wire by way of the first conductive tab 4 and the second conductive tab 6. In this way, the same ignition interrupter may be used multiple times, even after it has been triggered to break the electrical connection and move to the open position. In various implementations, by non-limiting example, the reset tab 30 may be triggered, moved, or caused to move, manually or by any automated method.

Figure 2:
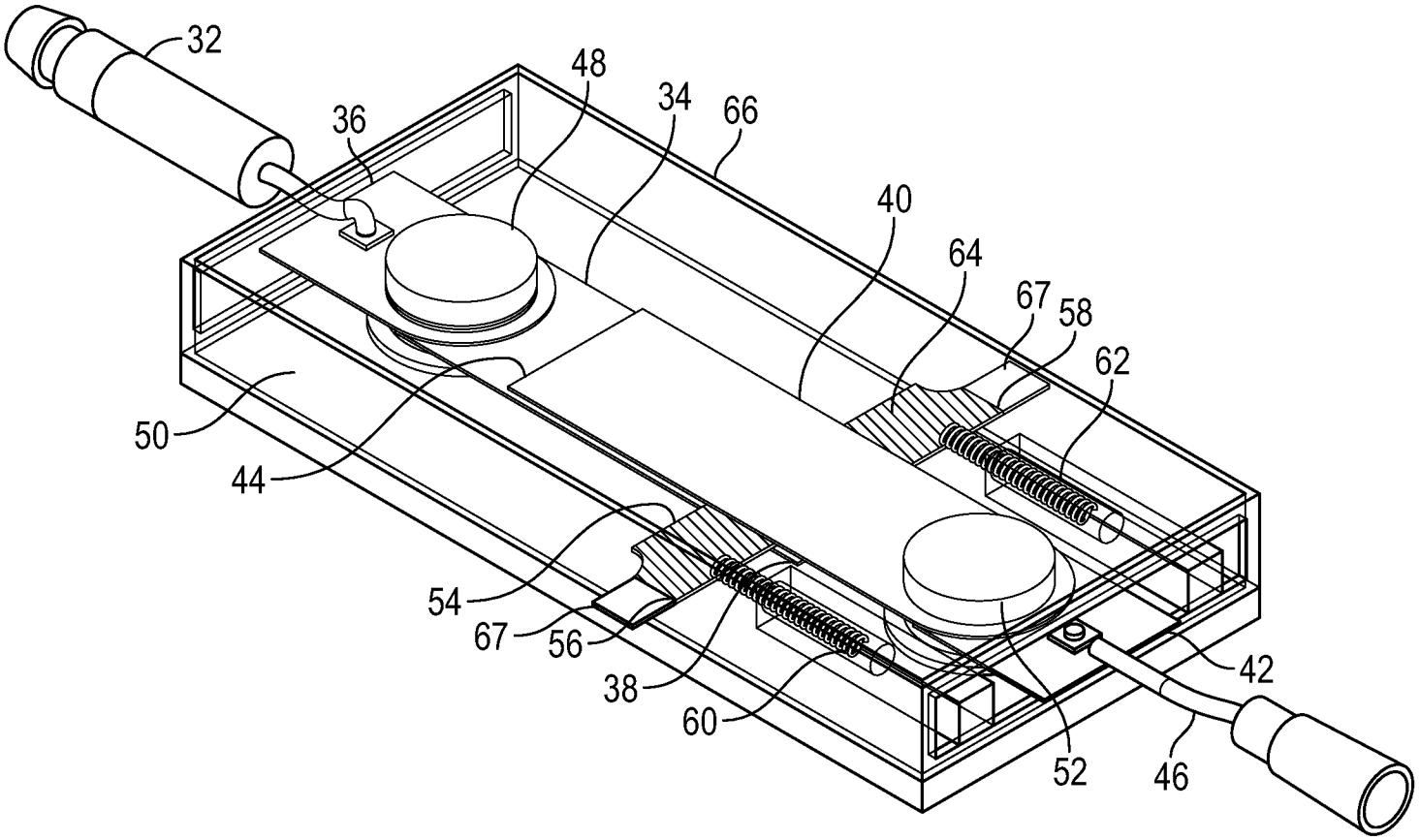
FIG. 2 illustrates a perspective see-through view of an implementation of an ignition interrupter.

Referring to FIG. 2, a perspective see-through view of an implementation of an ignition interrupter is illustrated. The ignition interrupter may include a spark plug terminal 32. As illustrated, a first conductive tab 34 may be configured to connect with the spark plug terminal 32. In various implementations, the first conductive tab 34 may have a first end 36 and a second end 38. As illustrated, the ignition interrupter may include a second conductive tab 40. In various implementations, the second conductive tab 40 may have a first end 42 and a second end 44. In various implementations, the second end 44 of the second conductive tab 40 may overlap over the second end 38 of the first conductive tab 34. In other various implementations, by non-limiting example, the first conductive tab 34 may overlap over the second conductive tab 40. The second conductive tab 40 may be configured to couple to a spark plug wire 46. A first tab holder 48 is coupled with the first conductive tab 34 and to a base 50. A second tab holder 52 is coupled with the second conductive tab 40 and to the base 50. A sled 54 is positioned between the first conductive tab 34 and the second conductive tab 40. In various implementations, the sled may be formed of high temperature resistant thermoplastic composites. In some implementations, the sled may be formed of metal that is coated with high temperature thermoplastic composites. As illustrated, the sled 54 may have a first end 56 and a second end 58. As illustrated, a first spring 60 may be coupled to the first end 56 of the sled 54, and a second spring 62 may be coupled to the second end 58 of the sled 54. The springs may be formed of materials similar to the sled high temperature resistant thermoplastics such as Polyamideimides (PAIs), High-performance polyamides (HPPAs), Polyimides (PIs), Polyketones, Polysulfone derivatives-a, Polycyclohexane dimethyl-terephthalates (PCTs), Fluoropolymers, Polyetherimides (PEIs), Polybenzimidazoles (PBIs), Polybutylene terephthalates (PBTs), Polyphenylene sulfides, Syndiotactic polystyrene, and any others described herein.

Still referring to FIG. 2, a conductive portion 64 of the sled 54 may be in contact with the first conductive tab 34 and the second conductive tab 40 when the sled 54 is in the closed position. In various implementations, by non-limiting example, the conductive portion 64 of the sled 54 may be made of any electrically conductive material so as to allow the flow of voltage between the spark plug terminal 32 and the spark plug wire 46 by way of the first conductive tab 34, the conductive portion 64 of the sled 54, and the second conductive tab 40, when the sled 54 is in the closed position. In various implementations, as the first spring 60 and the second spring 62 are decompressed, the sled moves into the gap between the first conductive tab 34 and the second conductive tab 40, creating a space, thereby preventing the conductive portion 64 of the sled 54 to complete the path of the flow of electricity or voltage. As illustrated, the ignition interrupter may be enclosed within a molded housing 66. In various implementations, the molded housing 66 may enclose, or may be positioned around, at least the base 50, the first conductive tab 34, and the second conductive tab 40. As illustrated, the ignition interrupter may also include at least one reset tab 67. In various implementations, by non-limiting example, the reset tab 67 may be coupled to, or may be an extension of the sled 54.

Figure 3:
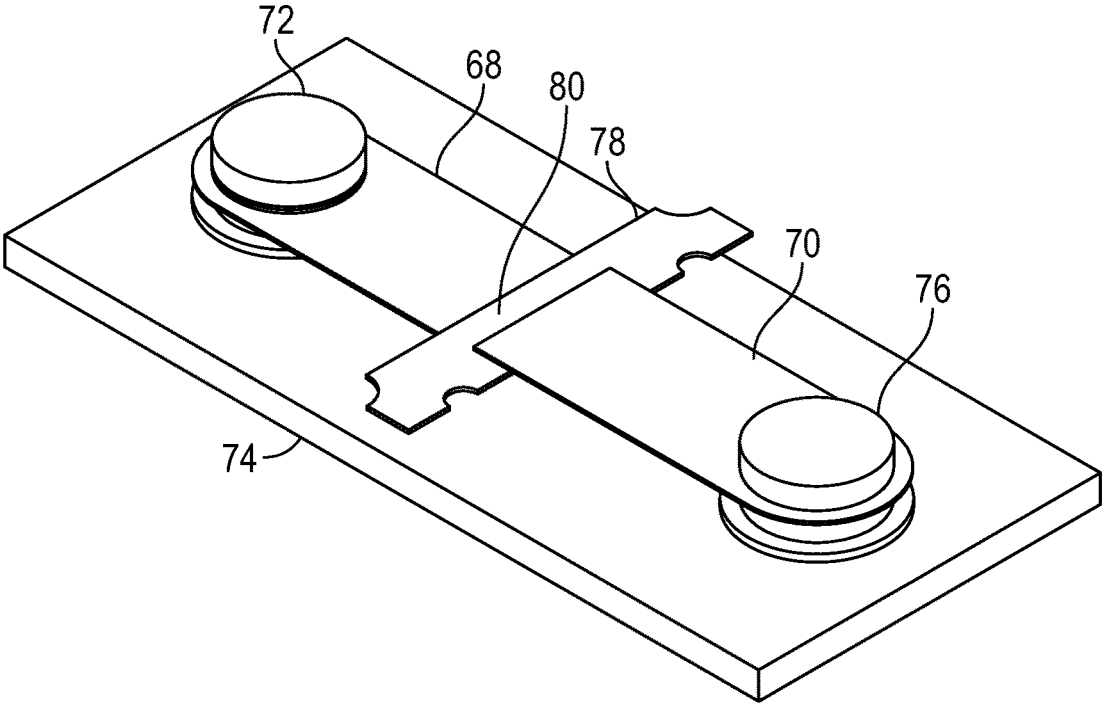
FIG. 3 illustrates an implementation of a part of an ignition interrupter in an open position.

Referring to FIG. 3, an implementation of a part of an ignition interrupter in an open position is illustrated. As illustrated, a first conductive tab 68 may be coupled to a base 74 by way of a first tab holder 72. As illustrated, a second conductive tab 70 may be coupled to the base 74 by way of a second tab holder 76. As illustrated, a sled 78 may be positioned or coupled between the first conductive tab 68 and the second conductive tab 70. In various implementations, when the sled 78 is moved along the first and second conductive tabs, a conductive portion 80 of the sled 78 interrupts the electrical connection of the first conductive tab 68 with the second conductive tab 70, when the sled 78 is in the open position. In various implementations, by non-limiting example, the sled 78 may move in any direction or fashion so as to break or interrupt the electrical connection.

Figure 4:
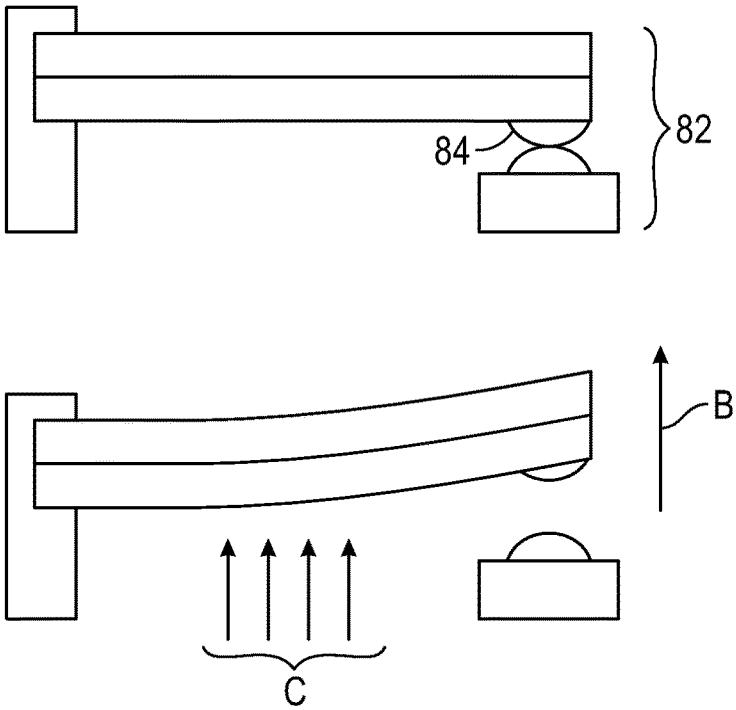
FIG. 4 illustrates an implementation of a snap disc or a heat activated actuator.

Referring to FIG. 4, an implementation of a snap disc or a heat activated actuator is illustrated. This implementation is a bimetallic snap disc 82, or actuator, though other thermally sensitive systems may also be used. As illustrated in FIG. 3, when a pre-determined amount of heat is applied to the snap disc 82, or actuator, the heat shown along lines C, the snap disc 82 may move and break the electrical connection 84, which movement or breakage is depicted along line B in FIG. 3. In particular implementations, the snap disc 82 may release the sled or breaker when the snap disc 82 reaches or detects a temperature of at least 180 degrees Fahrenheit. In other implementations, the sled may be released at temperatures greater than or less than 180 degrees Fahrenheit. By having an ignition interrupter that is thermally activated, with a snap disc 82 that is made of a thermally sensitive material, temperatures ambient to a motor and/or spark plug may be controlled. Such an ignition interrupter may be a valuable safety feature for systems to ensure that the system does not overheat. Such systems may include, among others, generators or engine driven equipment, particularly those generators or engines operating in an enclosed space.

In various implementations, the snap disc 82, or actuator, may be a thermal actuator, including, by non-limiting example, a micro-electromechanical system (MEMS) thermal actuator. The MEMS thermal actuator may generate motion by thermal expansion amplification. In other implementations, the actuator may be a push actuator. In such implementations, the push actuator may be activated once a predetermined temperature is reached. In various implementations, the actuator may initiate the breaking of the conductive path once the actuator reaches a predetermined temperature.

Figure 5:
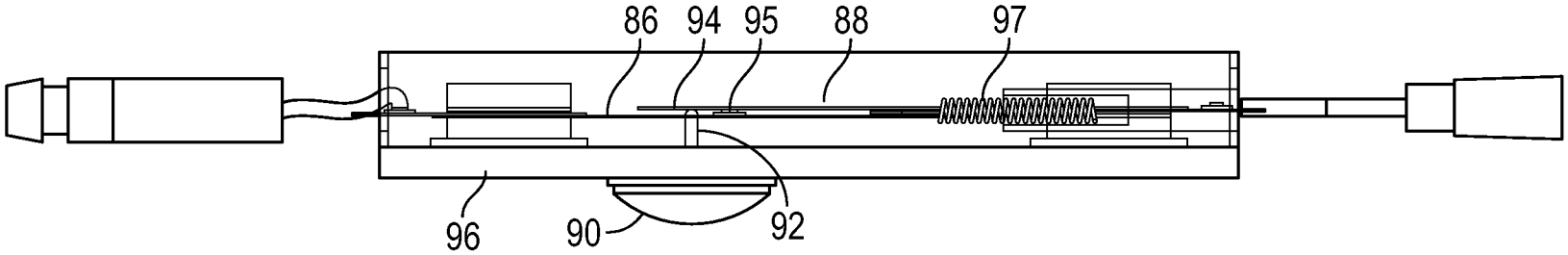
FIG. 5 illustrates a side see-through view of an implementation of an ignition interrupter with a snap disc.

Referring to FIG. 5, a side see-through view of an implementation of an ignition interrupter with a snap disc is illustrated. As illustrated, a second end 94 of a second conductive tab 88 overlaps over a first conductive tab 86. In various implementations, by non-limiting example, the overlapping of conductive tabs may create an electrical connection whereby voltage may flow through the ignition interrupter, or a sled 95 may be used to create a bridge between the first conductive tab 86 and the second conductive tab 88 in order to create the electrical connection and allow the flow of voltage, as previously disclosed in this document. As illustrated, the first conductive tab 86 and the second conductive tab 88 may be coupled to a base 96 of the ignition interrupter. In various implementations, by non-limiting example, the conductive tabs may be coupled, affixed, or otherwise held in place or attached to the base 96, or any other portion of the ignition interrupter, though other suitable methods. As illustrated, the ignition interrupter may also include a snap disc 90 and a pin 92. In various implementations, the pin 92 holds the sled 95 in the closed position by holding the sled 95 against the pin 92 on one side of the sled 95, and by springs 97 on the other side of the sled 95 (also depicted in FIG. 6), allowing the flow of voltage between the first conductive tab 86 and the second conductive tab 88. In various implementations, as the springs 97 decompress, the sled 95 slides in the direction of the force of the decompressing springs 97, being moved by the springs 97, over the pin 92, thereby breaking the electrical connection, or preventing the flow of voltage, as the sled 95 is shifted into the open position. In various implementations, the pin 92 need not move a great distance to release the sled 95 into the open position. In particular implementations, the sled 95 may be released if the pin 92 is moved a 0.030 inches under the material of the sled 95. In other implementations, the pin 92 may require more or less movement than 0.030 inches to release the sled 95 into the open position.

Figure 6:
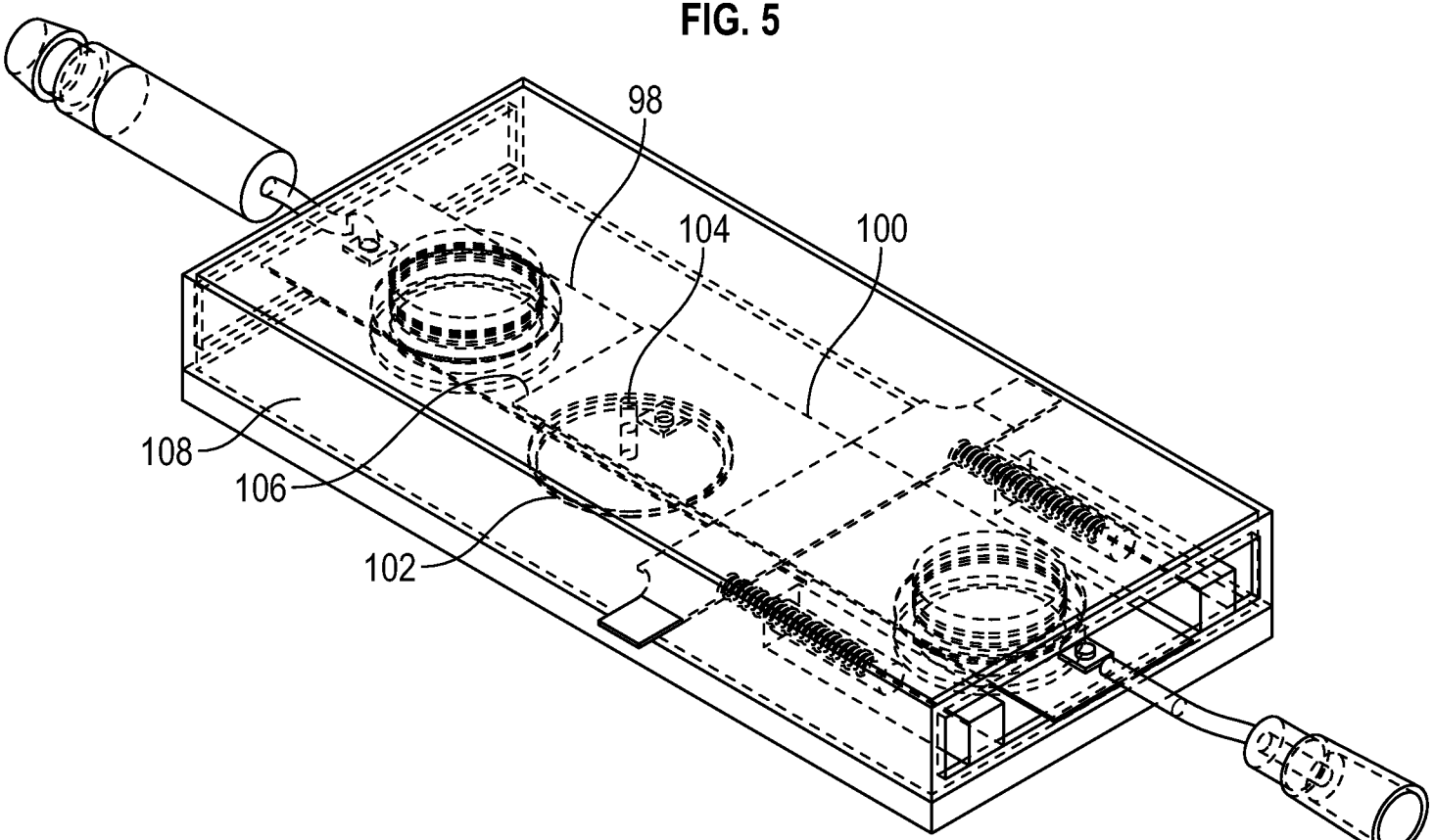
FIG. 6 illustrates a perspective see-through view of an implementation of an ignition interrupter with a snap disc.

Referring to FIG. 6, a perspective see-through view of an implementation of an ignition interrupter with a snap disc is illustrated. As illustrated, a second end 106 of a second conductive tab 100 overlaps with a first conductive tab 98. As illustrated, the second conductive tab 100 overlaps over the first conductive tab 98, though in other various implementations, the first conductive tab 98 may overlap over the second conductive tab 100. The ignition interrupter may include a base 108, and the conductive tabs may be coupled to the base 108. As illustrated, the ignition interrupter may also include a snap disc 102 and a pin 104. The snap disc 102 and the pin 104 may be positioned on a side of the base 108 opposite the first conductive tab 98 and the second conductive tab 100. In various other implementations, the snap disc 102 and the pin 104 may be positioned on any side of the ignition interrupter.

Figure 7:
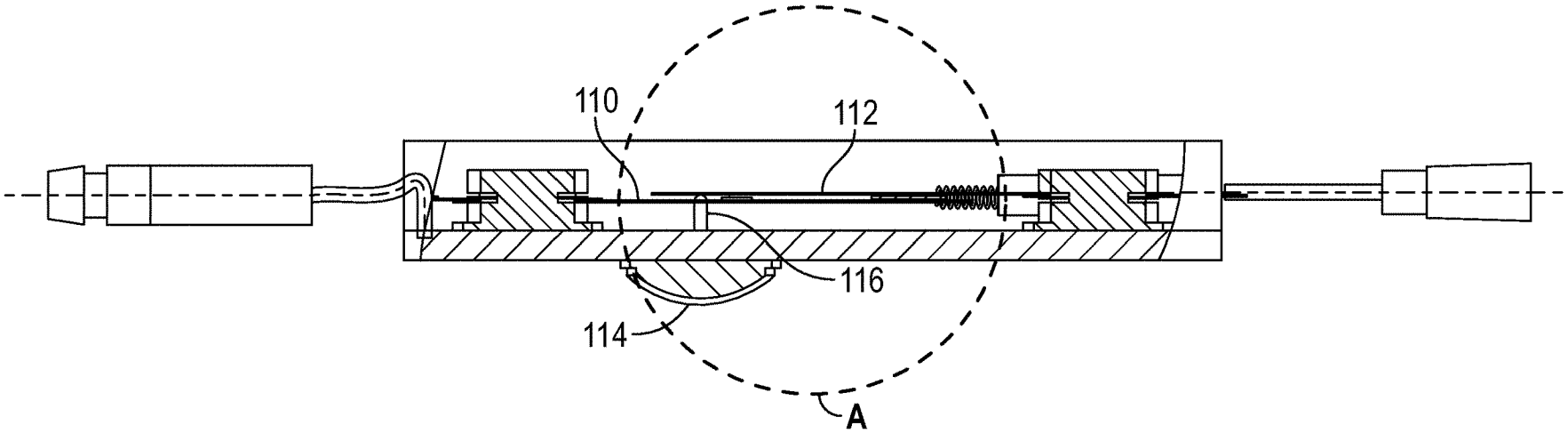
FIG. 7 illustrates a side view of an implementation of an ignition interrupter with a snap disc.

Referring to FIG. 7, a side view of an implementation of an ignition interrupter with a snap disc is illustrated. The ignition interrupter may include a first conductive tab 110, a second conductive tab 112, a snap disc 114, and a pin 116. The aforementioned elements may function and be arranged, through the methods previously disclosed herein.

Figure 8:
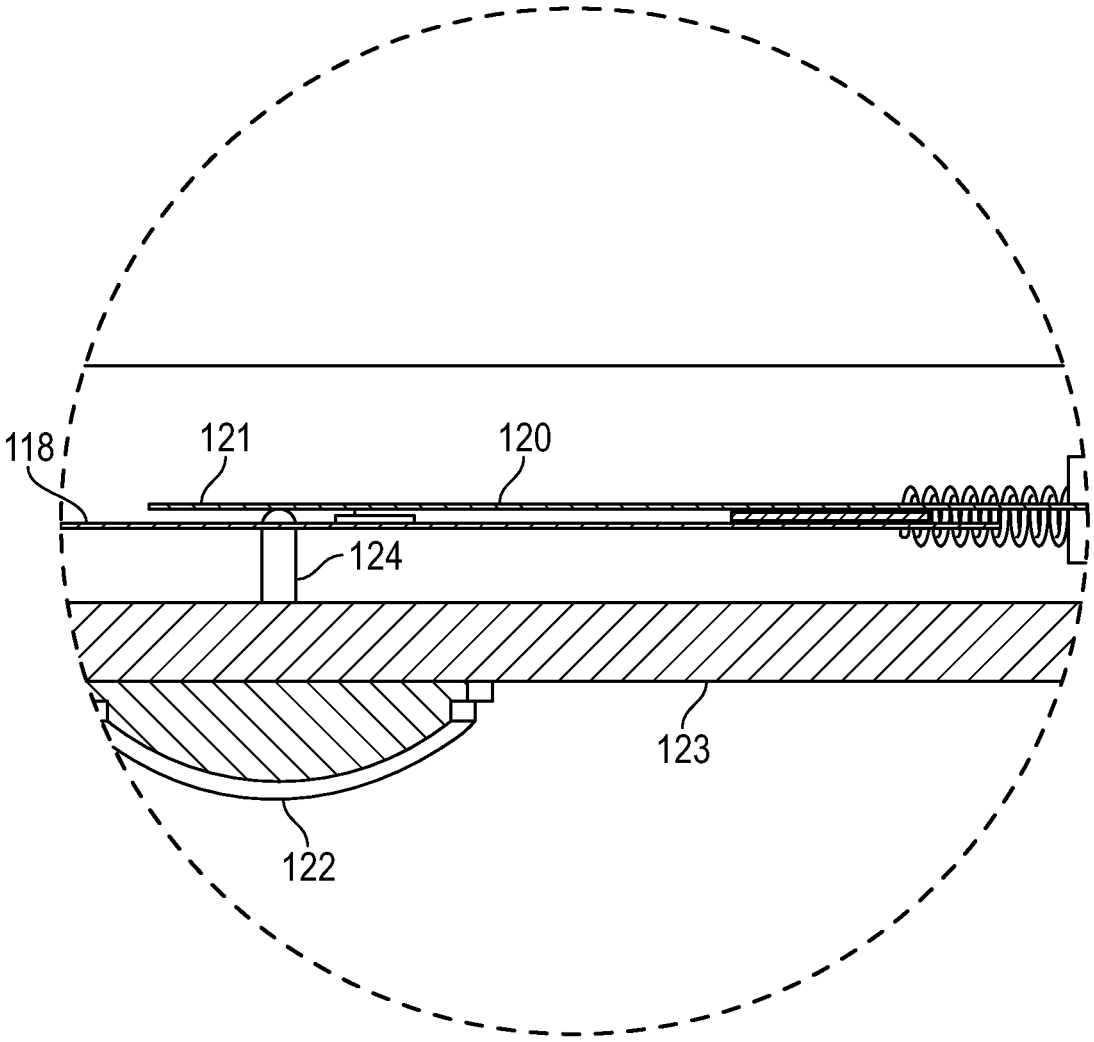
FIG. 8 illustrates a sectional view of an implementation of an ignition interrupter with a snap disc taken along sectional line A in FIG. 7.

Referring to FIG. 8, a sectional view of an implementation of an ignition interrupter with a snap disc taken along sectional line A in FIG. 7 is illustrated. A second conductive tab 120 overlaps with a first conductive tab 118. As illustrated, a pin 124 coupled with a snap disc 122 extends through a base 123. The pin 124 may be coupled with a second end 121 of the second conductive tab 120. In various implementations, the pin 124 extends through an opening in the first conductive tab 118. In various implementations, the snap disc 122 may be configured to raise the pin 124 when the snap disc 122, or an actuator of the snap disc 122, is exposed to a predetermined temperature or temperature threshold. In various implementations, the snap disc 122 then creates a gap between the first conductive tab 118 and the second conductive tab 120, breaking or interrupting the flow of voltage, or any electrical connection in the open position of the ignition interrupter.

Figure 9:
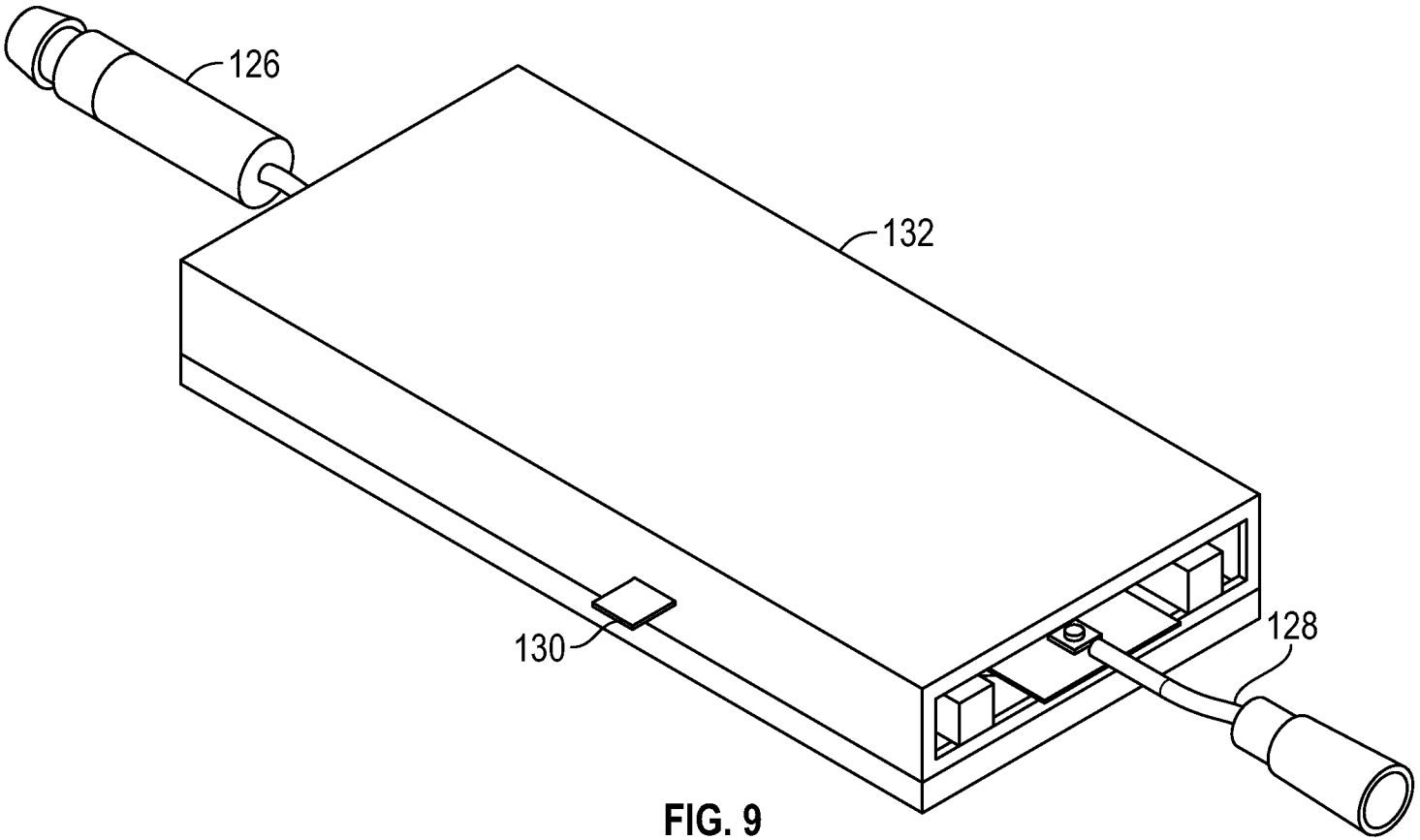
FIG. 9 illustrates a perspective view of a molded housing around an implementation of an ignition interrupter.

Referring to FIG. 9, a perspective view of a molded housing around an implementation of an ignition interrupter is illustrated. The molded housing 132 encloses the ignition interrupter. In various implementations, the molded housing 132 may enclose or be positioned around any part, or parts, of the ignition interrupter. The molded housing may be formed of, by non-limiting example, thermoplastics capable of withstanding high temperatures such as polyamideimides (PAIs), high-performance polyamides (HPPAs), polyimides (PIs), polyketones, polysulfone derivatives-a, polycyclohexane dimethyl-terephthalates (PCTs), fluoropolymers, polyetherimides (PEIs), polybenzimidazoles (PBIs), polybutylene terephthalates (PBTs), polyphenylene sulfides, syndiotactic polystyrene, polyetheretherketone (PEEK), polyphenylene sulfide (PPS), polyether imide (PEI), kapton, and other materials capable of withstanding high temperatures.

As illustrated, a spark plug terminal 126 extends out of the molded housing 132, and a spark plug wire 128 extends out of the molded housing 132 on the opposite side. In various implementations, the spark plug terminal or male portion of the spark plug may be formed of sintered alumina in the insulator portions, Aluminum oxide and metal in the insulator tip, zinc chromate in the case/shell, and the central electrode may be formed of copper and/or nickel. In various implementations, the interrupter interrupters may be compatible with spark plugs made of other materials. Various implementations of the spark plug wire 128 may be formed of copper, nickel, other conductive metals, or any combination thereof. As illustrated, a reset tab 130 extends out of the molded housing 132 on one side. In various implementations, the reset tab 130 may be exposed outside of the molded housing 132 to allow for greater accessibility in resetting the ignition interrupter. In various implementations, the ignition interrupter may include one or more reset tabs 130 along any side of the molded housing 132 or ignition interrupter.

Figure 10:
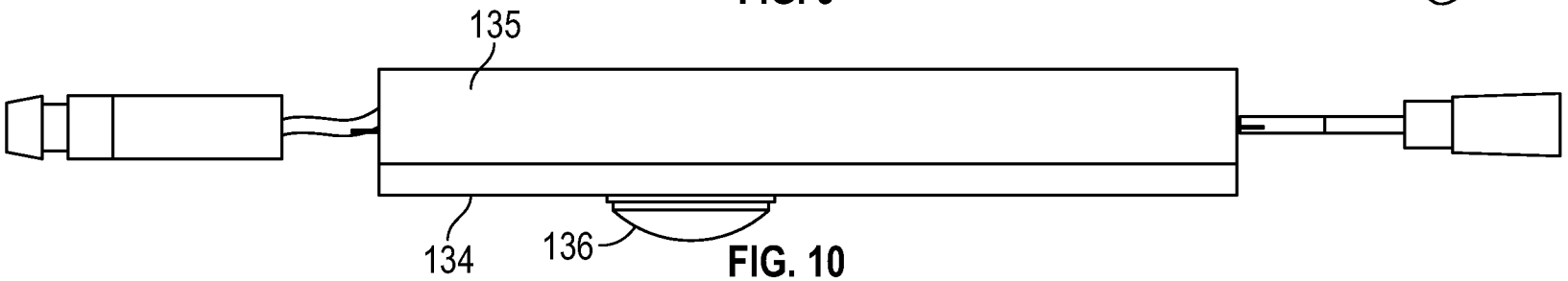
FIG. 10 illustrates a side view of a molded housing around an implementation of an ignition interrupter.

Referring to FIG. 10, a side view of a molded housing around an implementation of an ignition interrupter is illustrated. As illustrated, a base 134 of the ignition interrupter may be disposed along a bottom portion of the ignition interrupter. As illustrated, a snap disc 136 may also be disposed along the same bottom portion of the ignition interrupter, and may extend outward from, or be exposed from, a molded housing 135. The snap disk may include various components such as an insulator, an insulator tip, a case or shell, and an electrode. In various implementations, the snap disk may be formed of materials similar to the spark plug terminal such as, by non-limiting example, aluminum metal, copper, nickel, other conductive materials used in the automotive, vehicle, and engine industries. In some implementations, the insulative portions of the snap disk may include sintered alumina, aluminum oxide, and other insulators used in high temperature engines. In various implementations, by non-limiting example, the snap disc 136 may be positioned along any side of the molded housing 135, and may also be enclosed by the molded housing 135.

Figure 11:
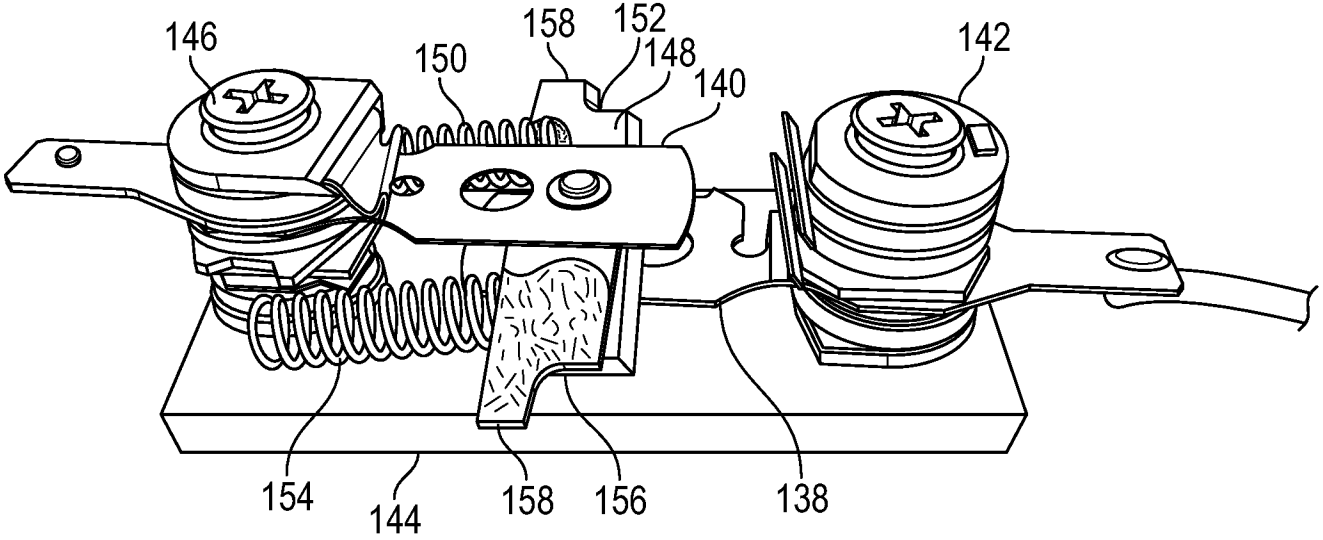
FIG. 11 illustrates a side view of an alternative implementation of an ignition interrupter.

Referring to FIG. 11, a side view of an alternative embodiment of an implementation of an ignition interrupter is illustrated. The ignition interrupter may include a first conductive tab 138 and a second conductive tab 140. In various implementations, the first conductive tab 138 may run parallel with, and overlap with, a second conductive tab 140. In other implementations, the first conductive tab 138 and the second conductive tab 140 may be positioned perpendicularly, or in any other position where they overlap, or connect at any point in order to complete an electrical connection. As illustrated, the first conductive tab 138 may be coupled to a base 144 by a first tab holder 142, and the second conductive tab 140 may be coupled to the base 144 by a second tab holder 146. In various implementations, the first conductive tab 138 and the second conductive tab 140 may be held in place by any other method of attachment or coupling, including coupling directly with the base 144.

Still referring to FIG. 11, the ignition interrupter may include a sled 148. In various implementations, the sled 148 may include a first end 152 and a second end 156. As illustrated, the sled 148 may be positioned substantially perpendicular to a plane of the first conductive tab 138 and the second conductive tab 140. As illustrated, the sled 148 may be coupled between the first conductive tab 138 and the second conductive tab 140. In various implementations, the sled 148 may be configured to move along a plane parallel with the first conductive tab 138 and the second conductive tab 140 to an open position in a gap between the first conductive tab 138 and the second conductive tab 140, decompressing a first spring 150 and a second spring 154. In various implementations, the movement of the sled 148 to the open position may break an electrical connection between the first conductive tab 138 and the second conductive tab 140, by creating a gap between the first conductive tab 138 and the second conductive tab 140, thereby preventing the flow of voltage through the ignition interrupter. In various implementations, the first conductive tab 138 and the second conductive tab 140, when touching, may allow the flow of voltage between the first conductive tab 138 and the second conductive tab 140, when the sled 148 is in a closed position, and there is no gap between them. In various implementations, when the sled 148 is moved to the closed position, the first spring 150 and the second spring 154 may be compressed.

Still referring to FIG. 11, as illustrated, the ignition interrupter may include at least one, or more, reset tabs 158. In various implementations, by non-limiting example, the reset tab 158 may be coupled to the sled 148, on a first end 152 of the sled 148, and/or on a second end 156 of the sled 148, or on any other location on or along the sled 148. In various implementations, the reset tab 158 may be configured to move the sled 148 to the closed position out of the gap between the first conductive tab 138 and the second conductive tab 140, where the movement compresses the first spring 150 and the second spring 154. In various implementations, the reset tab 158 may be used to reset the ignition interrupter, or to move the sled 148 back into the closed position after the system has been triggered to break the electrical connection, thereby restoring the flow, or the ability of the electricity to flow, between the first conductive tab 138 and the second conductive tab 140. In this way, the same ignition interrupter may be used multiple times, even after it has been triggered to break the electrical connection and move to the open position. In various implementations, by non-limiting example, the reset tab 158 may be triggered, moved, or caused to move, manually or by any automated method.

Figure 12:
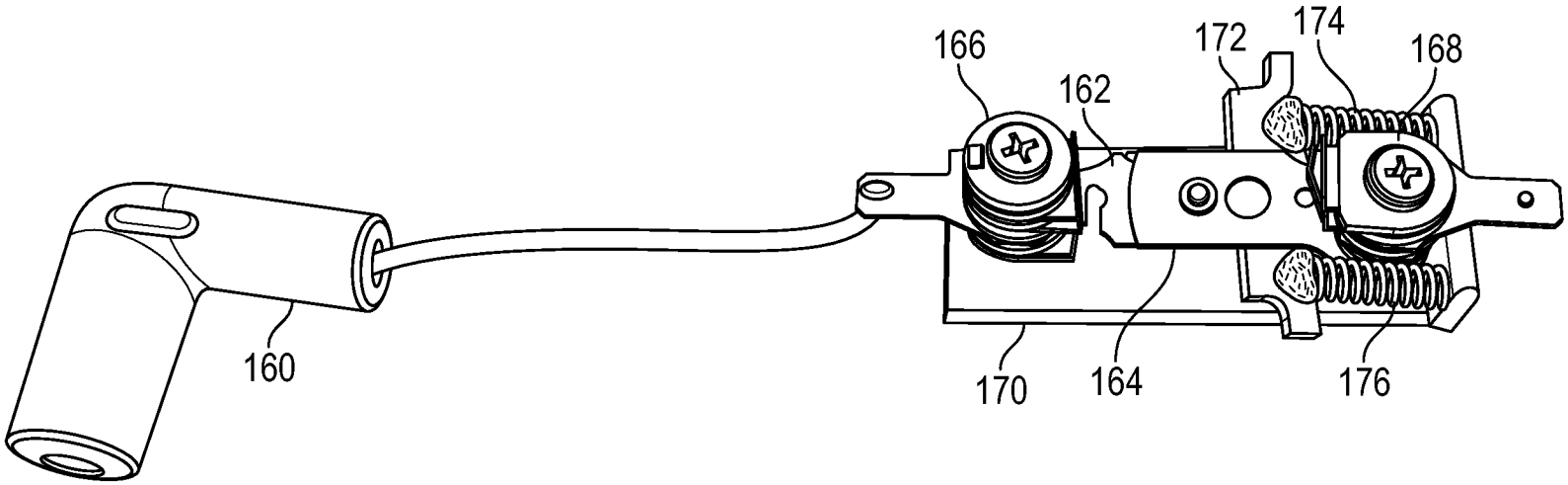
FIG. 12 illustrates a top view of the alternative implementation of an ignition interrupter.

Referring to FIG. 12, a top view of the alternative implementation of an ignition interrupter FIG. 11 is illustrated. The ignition interrupter may include a spark plug terminal 160. As illustrated, a first conductive tab 162 may be configured to connect with the spark plug terminal 160. As illustrated, the ignition interrupter may include a second conductive tab 164. In various implementations, the second conductive tab 164 may overlap over the first conductive tab 162. In other various implementations, by non-limiting example, the first conductive tab 162 may overlap over the second conductive tab 164. As illustrated, a first tab holder 166 may couple the first conductive tab 162 to a base 170. A second tab holder 168 may couple the second conductive tab 164 to the base 170. As illustrated, a sled 172 may be positioned between the first conductive tab 162 and the second conductive tab 164. As illustrated, a first spring 174 may be coupled to the sled 172, and a second spring 176 may be coupled to an opposite end of the sled 172.

Figure 13:
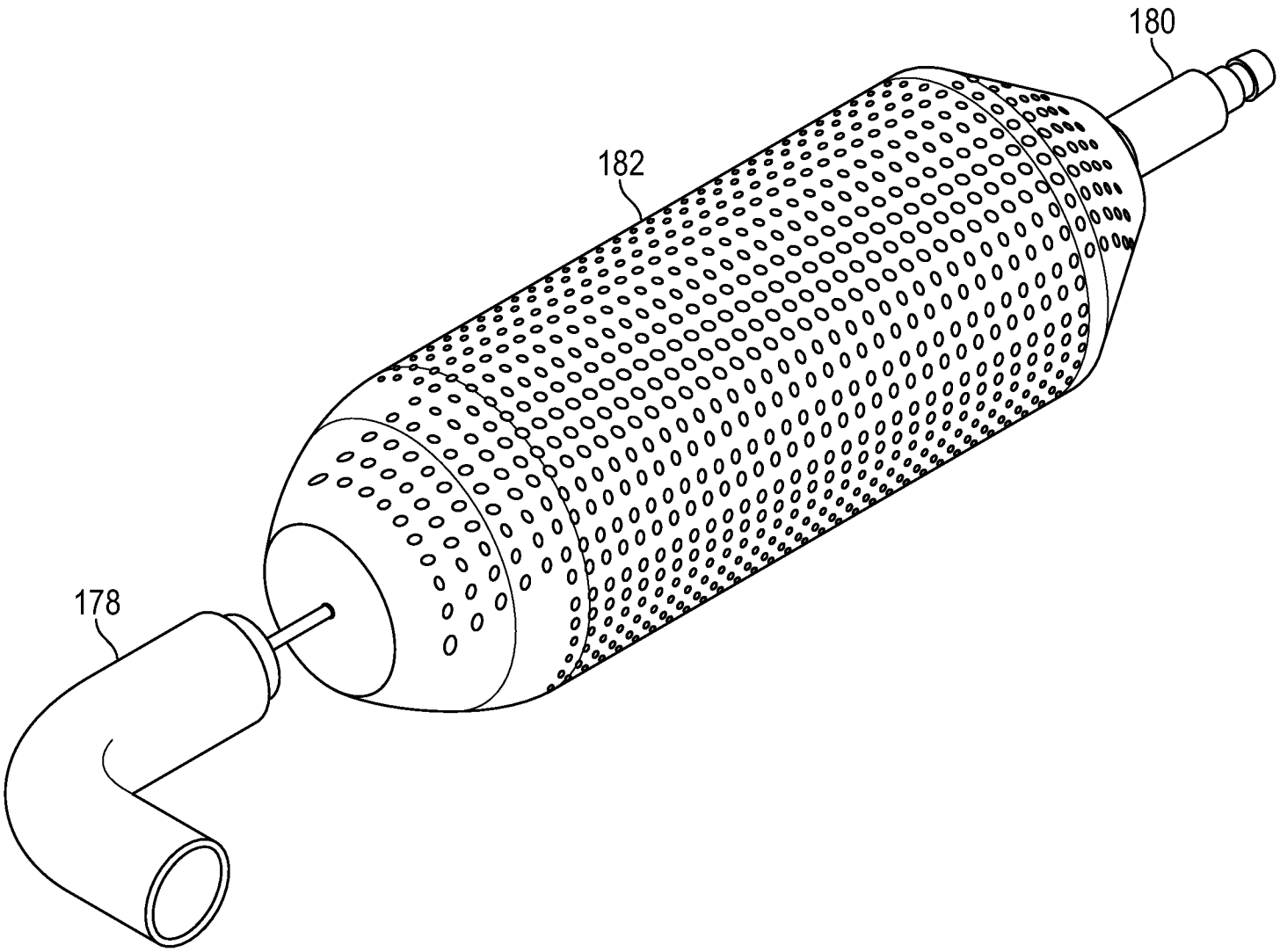
FIG. 13 illustrates a perspective view of an another alternative implementation of an ignition interrupter.

Referring to FIG. 13, a perspective view of an alternative embodiment of an implementation of an ignition interrupter is illustrated. The ignition interrupter may include a spark plug terminal 178 and spark plug wire 180 similar to, or the same as, any spark plug terminal and spark plug wire previously disclosed herein. As illustrated, the ignition interrupter may be enclosed within a molded housing 182. In various implementations, by non-limiting example, the molded housing 182 may fully enclose, or at least partially enclose, the ignition interrupter.

Figure 14:
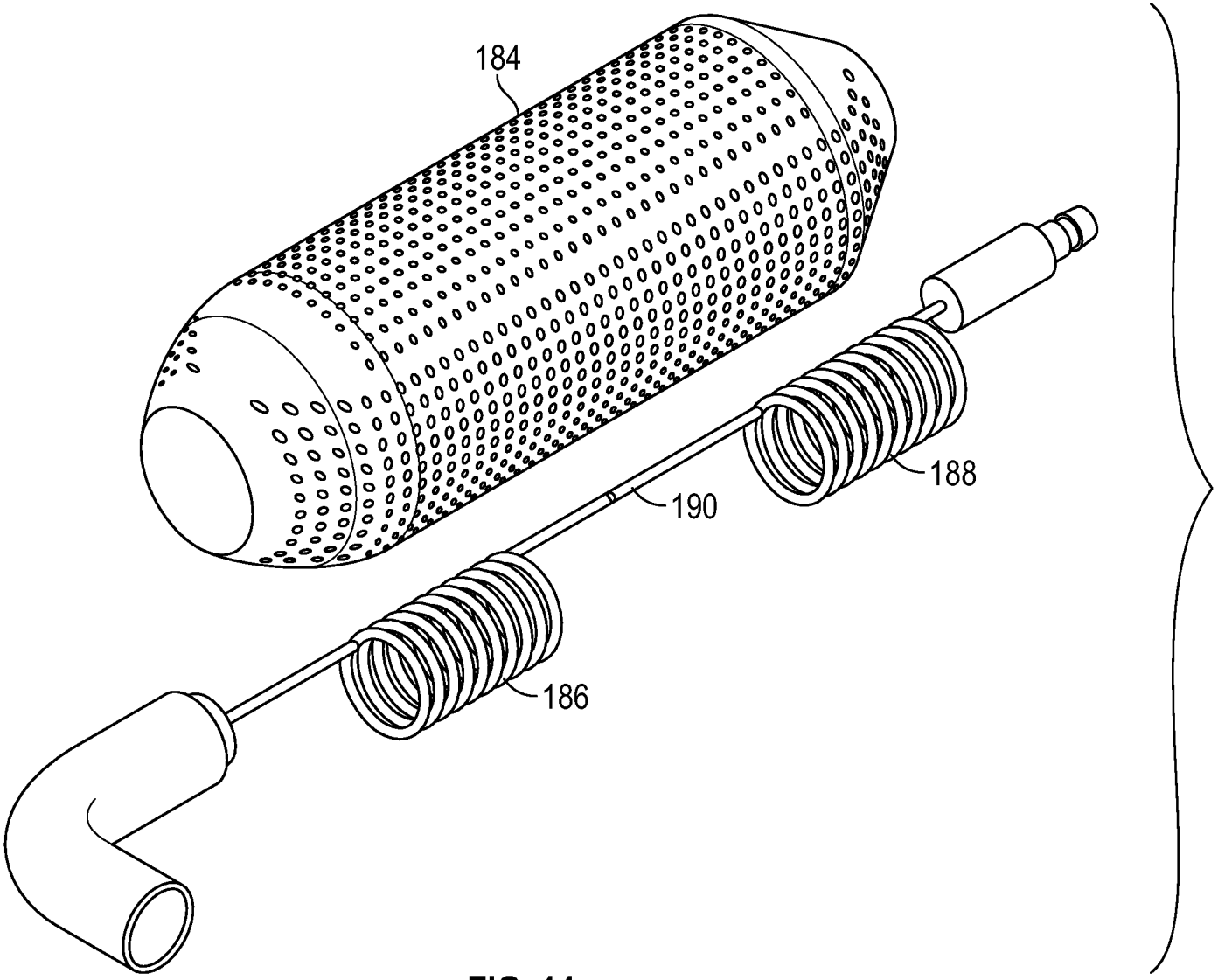
FIG. 14 illustrates a perspective view of the alternative implementation of an ignition interrupter with a coiled section in FIG. 13.

Referring to FIG. 14, a perspective view of the alternative embodiment in FIG. 13 of an implementation of an ignition interrupter with a coiled section is illustrated. As illustrated, a conductive portion 190 or channel of the ignition interrupter may include one or more coiled sections that act as a spring with a first spring 186 and a second spring 188. In various implementations, a soldered portion may be included in the conductive portion 190. In various implementations, when the ambient air reaches a predetermined temperature, the solder portion may break and the one or more springs may break the conductive portion 190 to the open position, and interrupt the flow of voltage through the ignition interrupter. As illustrated, the ignition interrupter may be enclosed or housed within a molded housing 184.

Figure 15:
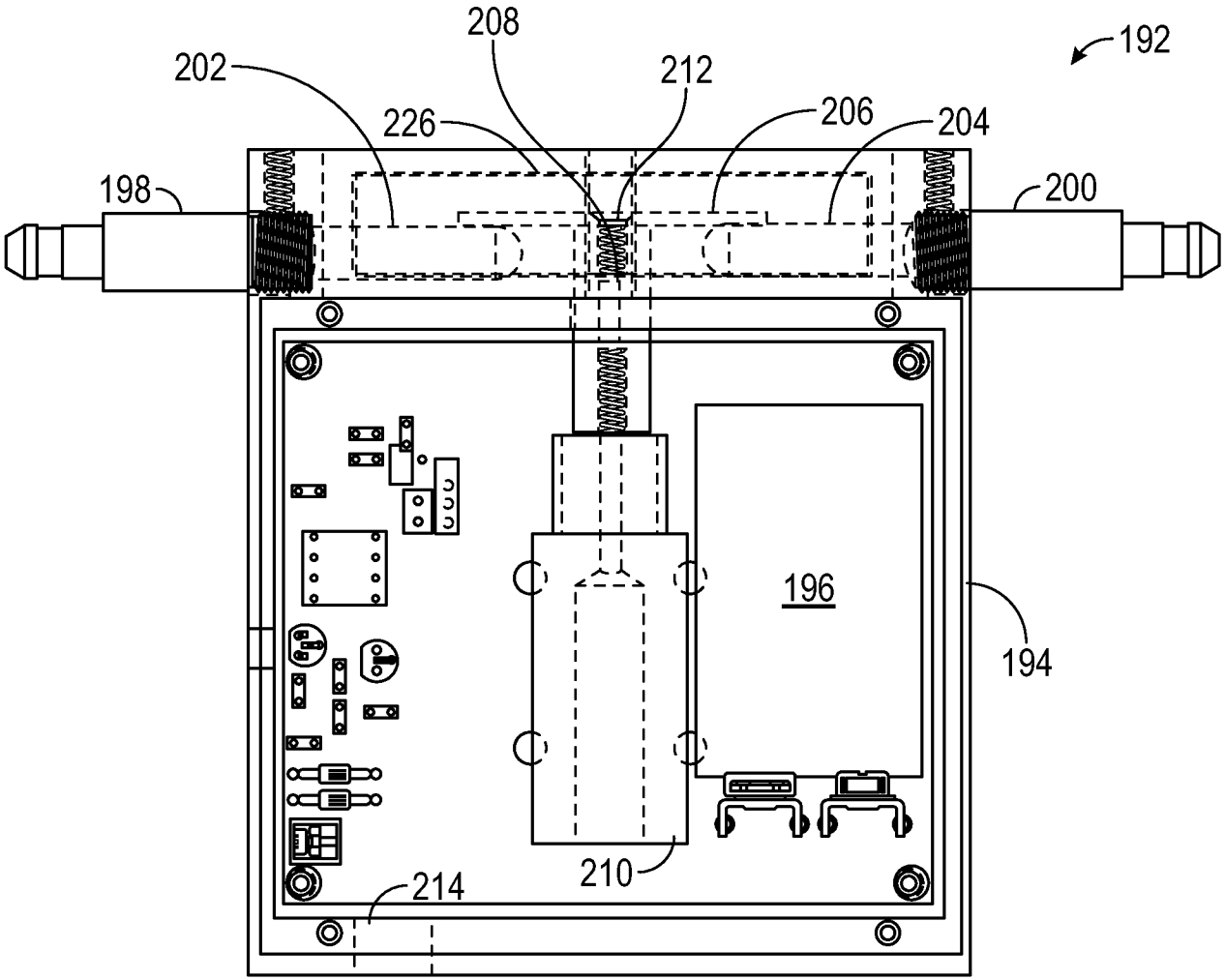
FIG. 15 is a partial see-through diagram of an implementation of a ignition interrupter.

Referring to FIG. 15, another implementation of an ignition interrupter 192 is illustrated in a partial see-through view. As illustrated, the ignition interrupter 192 includes housing 194 which in this implementation encloses the various components including battery 196. In other implementations, however, the battery 196 may not be included within the housing or may be coupled to the outside of the housing 194. The battery may be a 9V battery in various implementations. First spark plug terminal 198 extends from housing 194 and, as illustrated, may be threadedly coupled thereto in various implementations. Second spark plug terminal 200 likewise extends from housing 194 and in this implementation extends from an opposing side of the housing 194 from the first spark plug terminal 198. However, in other implementations, the first and second spark plug terminals may extend out the same side of the housing.

As illustrated in FIG. 15, the first spark plug terminal 198 includes a first internal contact 202 which may be coupled thereto or formed integrally with the first spark plug terminal 198 in various implementations. Similarly, the second spark plug terminal 200 includes a second internal contact 204 which is similarly coupled thereto or formed integrally with the second spark plug terminal 200. Contactor 206 is illustrated in FIG. 15 as being in contact with both the first internal contact 202 and with the second internal contact 204. The contactor implementation illustrated in FIG. 15 is in the form of a plate (shown in cross section extending into the paper) that rests against the first and second internal contacts 202, 204. However, in other implementations, the contactor may have other forms, including, by non-limiting example, a bar, a rod, a curved surface, or any other shape designed to make contact with the first and second internal contacts. In various implementations, the contactor 206 may be biased against the first internal contact 202 and the second internal contact 204. This biasing may be done using a spring (not shown) in various implementations or a rubber material may be utilized in other implementations.

Plunger 208 is illustrated in a rest position below contactor 206 and is connected with solenoid 210. When solenoid 210 is activated, plunger 208 is moved upwardly in FIG. 15 against contactor 206, causing it to break contact or cease contacting the first internal contact 202 and the second internal contact 204. In the implementation illustrated in FIG. 15, spring 212 is used to bias the plunger back to the rest position after the solenoid deactivates, allowing the contactor 206 to resume contact with the first internal contact 202 and the second internal contact 204. When the contact between the contactor 206 and the first internal contact 202 and the second internal contact 204 is broken, electricity cannot flow between the first spark plug terminal 198 and the second spark plug terminal 200.

Temperature sensor 214 is coupled to/into housing 194 and is used to measure the ambient temperature around the housing 194 and output a corresponding voltage signal. A wide variety of temperature sensors may be employed in various implementations. In a particular implementation, the temperature sensor may be marketed under the tradename LM35CAZ by Texas Instruments of Dallas, Tex.

Figure 16:
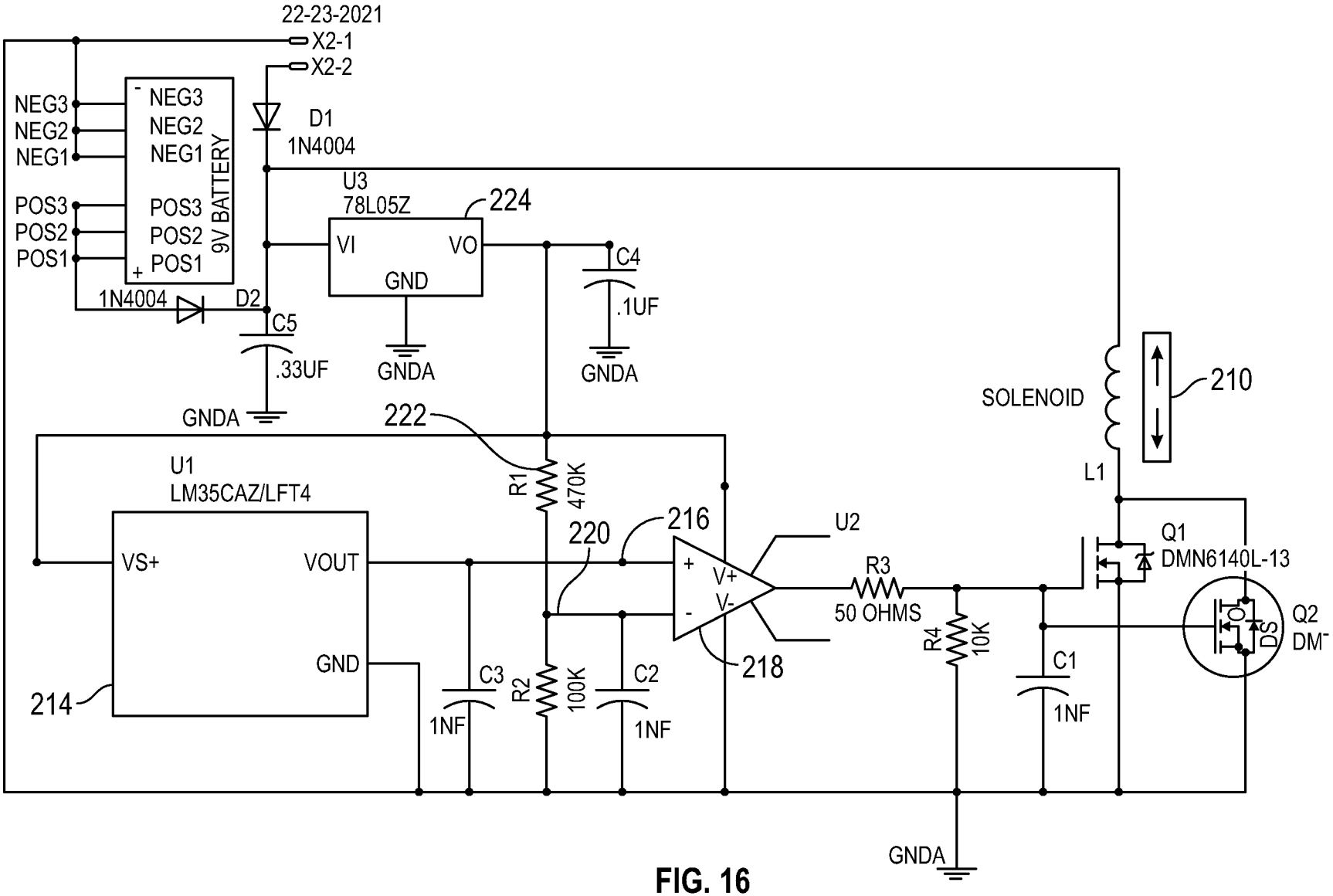
FIG. 16 is an electrical schematic of an implementation of the electrical components of an ignition interrupter implementation like that illustrated in FIG. 15.

Referring to FIG. 16, an electrical schematic of the implementation of the ignition interrupter 192 of FIG. 15 is illustrated. Here, temperature sensor 214 measures the ambient temperature surrounding the housing and outputs a voltage signal 216 to one of the inputs of comparator 218. Comparator 218 uses a reference voltage 220 set using resistor 222 and the output of voltage regulator 224, which in this implementation is a 5V voltage regulator marketed under the tradename AS78L05Z by Diodes Incorporated of Plano, Tex. The resistance of resistor 222 is set to produce a reference voltage that corresponds with a predetermined temperature threshold. The predetermined temperature threshold in particular implementations may be set to a value/temperature designed to prevent damage to a generator caused by excessive temperature around the generator similar to the various other ignition interrupter implementations disclosed herein. During operation, when the voltage signal 216 from the temperature sensor 214 exceeds the reference voltage 220, then the comparator outputs a signal to the solenoid 210, causing it to activate, driving the plunger up and breaking the electrical and physical contact between the contactor 206 and the first internal contact 202 and the second internal contact 204. This causes the electricity passing through the first spark plug terminal 198 and second spark plug terminal 200 stop flowing, preventing flow of electricity to spark plug wires coupled with the terminals 198, 200 and stopping flow of electricity to a spark plug(s) connected to the spark plug wires. Where the spark plug is included in a generator, this causes the cylinder in which the spark plug(s) is connected to stop firing, working to shut the generator down.

Since the plunger 208 moves the contactor 206 against spring bias force from spring 212, when the voltage signal 216 from the temperature sensor 214 no longer exceeds the reference voltage 220, the comparator 218 no longer sends a signal to solenoid 210 and the spring bias force assists with pushing plunger 208 away from the contactor 206, restoring the ability for electricity to flow between the first spark plug terminal 198 and the second spark plug terminal 200. This can occur automatically when the temperature sensor 214 no longer senses a temperature above the predetermined temperature threshold. Where a generator is connected to the spark plug terminals, depending on the generator type, the generator may automatically restart or await a manual restarting process by the user.

Referring to FIG. 15, a magnet 226 may be coupled to the housing 194 either internally or externally to allow the housing to be magnetically coupled with a magnetic or magnetizable material during operation. In various system implementations, the ignition interrupter 192 can be coupled to the generator or motor being regulated itself or to a portion of an enclosure surrounding the generator or motor being regulated. Other coupling mechanisms, such as, by non-limiting example, screws, pins, hook and loop fasteners, tapes, and any other system for coupling two objects physically together may also be employed in various implementations.

In various implementations, the ignition interrupter 192 may be powered primarily using power from the first spark plug terminal 198 and the second spark plug terminal 200 with the battery functioning as a backup primarily for the temperature sensor and comparator circuity. In other implementations, the entire system may be powered using power from the battery. In other implementations, some portions of the system may be powered entirely using battery power while the remaining portions are energized using electricity from the spark plug terminals. A wide variety of possibilities of what components are powered by which power source(s) may be constructed in various implementations using the principles disclosed herein.

In places where the description above refers to particular implementations of ignition interrupters and implementing components, sub-components, methods and sub-methods, it should be readily apparent that a number of modifications may be made without departing from the spirit thereof and that these implementations, implementing components, sub-components, methods and sub-methods may be applied to other ignition interrupters.

What is claimed is:

1. A system for interrupting ignition comprising:

a first spark plug terminal coupled with a first internal contact, the first internal contact extending into a housing;

a second spark plug terminal coupled with a second internal contact, the second internal contact extending into the housing;

a contactor biased against the first internal contact and the second internal contact;

a plunger coupled with a solenoid coupled within the housing;

a battery coupled with the solenoid; and a temperature sensor coupled with the battery and the solenoid.

2. The system of claim 1, wherein the solenoid is configured to move the plunger against the contactor to break an electrical connection with the first internal contact and with the second internal contact when the temperature sensor indicates a predetermined temperature threshold has been passed.

3. The system of claim 2, further comprising a comparator coupled with an output of the temperature sensor, the comparator configured to send a signal to the solenoid when the predetermined temperature threshold has been passed.

4. The system of claim 3, further comprising a resistor coupled with a power regulator coupled with the battery, the resistor configured to set a reference voltage for the comparator corresponding with the predetermined temperature threshold.

5. The system of claim 1, further comprising a magnet coupled to the housing.

6. The system of claim 1, wherein the first spark plug terminal and the second spark plug terminal are configured to couple with a spark plug wire coupled with a terminal of a single spark plug.

7. The system of claim 1, wherein the contactor is a plate.

8. A system for interrupting ignition comprising:

a first spark plug terminal coupled with a second spark plug terminal through a contactor plate in contact with a first internal contact and a second internal contact, the first spark plug terminal and second spark plug terminal extending from a housing;

a plunger coupled with a solenoid coupled within the housing; and a temperature sensor coupled with the solenoid.

9. The system of claim 8, wherein the solenoid is configured to move the plunger against the contactor plate to break an electrical connection with the first internal contact and with the second internal contact when the temperature sensor indicates a predetermined temperature threshold has been passed.

10. The system of claim 9, further comprising a comparator coupled with an output of the temperature sensor, the comparator configured to send a signal to the solenoid when the predetermined temperature threshold has been passed.

11. The system of claim 10, further comprising a resistor coupled with a power regulator coupled with a battery, the resistor configured to set a reference voltage for the comparator corresponding with the predetermined temperature threshold.

12. The system of claim 8, further comprising a magnet coupled to the housing.

13. The system of claim 8, wherein the first spark plug terminal and the second spark plug terminal are configured to couple with a spark plug wire coupled with a terminal of a single spark plug.

14. The system of claim 8, wherein the contactor plate is spring biased.

15. A method for interrupting ignition comprising:

coupling a first spark plug terminal with first portion of a spark plug wire of a single spark plug;

coupling a second spark plug terminal with a second portion of the spark plug wire of the single spark plug;

using a temperature sensor, generating a voltage signal corresponding with an ambient temperature of a housing to which the first spark plug terminal and the second spark plug terminal are coupled;

using a comparator, sending a signal to activate a solenoid when the voltage signal received from the temperature sensor exceeds a reference voltage corresponding with a predetermined temperature threshold;

breaking a contact between a contactor plate at the first spark plug terminal and second spark plug terminal using a plunger coupled with the solenoid; and stopping flow of electricity to the single spark plug coupled with the first portion of the spark plug wire and the second portion of the spark plug wire through breaking the contact of the contactor plate.

16. The method of claim 15, further comprising a resistor coupled with a power regulator and the method further comprising setting the reference voltage for the comparator corresponding with the predetermined temperature threshold using the resistor.

17. The method of claim 15, further comprising a magnet coupled to the housing.

18. The method of claim 15, wherein the contactor plate contacts a first internal contact of the first spark plug terminal and a second internal contact of the second spark plug terminal.

19. The method of claim 18, further comprising biasing the contactor plate against the first internal contact and against the second internal contact.

20. The method of claim 15, further comprising resuming flow of electricity to the single spark plug coupled with the first portion of the spark plug wire and the second portion of the spark plug wire through restoring contact of the contactor plate when the comparator stops sending the signal to activate the solenoid.

* * * * *